US006720513B2

(12) United States Patent
Fleissner et al.

(10) Patent No.: US 6,720,513 B2
(45) Date of Patent: Apr. 13, 2004

(54) ROTARY SWITCH CONFIGURATION FOR A HOUSEHOLD APPLIANCE

(75) Inventors: Reinhard Fleissner, Altenmarkt (DE); Ernst Huber, Trostberg (DE); Dirk Schumann, Rosenheim (DE)

(73) Assignee: BSH Bosch und Siemens Aktingesellschaft, Munich (DE)

( * ) Notice: Subject to any disclaimer, the term of this patent is extended or adjusted under 35 U.S.C. 154(b) by 0 days.

(21) Appl. No.: 10/384,997

(22) Filed: Mar. 10, 2003

(65) Prior Publication Data

US 2003/0209412 A1 Nov. 13, 2003

Related U.S. Application Data

(63) Continuation of application No. PCT/EP01/10292, filed on Sep. 6, 2001.

(30) Foreign Application Priority Data

Sep. 8, 2000 (DE) ..... 100 44 448

(51) Int. Cl.[7] ..... H01H 3/08
(52) U.S. Cl. ..... 200/336; 200/564; 200/566
(58) Field of Search ..... 200/295, 296, 200/336, 564, 566, 567, 545, 565

(56) References Cited

U.S. PATENT DOCUMENTS

| | | | | |
|---|---|---|---|---|
| 4,859,922 A | | 8/1989 | Tauchenitz et al. | |
| 4,920,823 A | | 5/1990 | Mohr et al. | |
| 6,281,453 B1 | * | 8/2001 | Uleski | 200/4 |
| 6,606,229 B2 | * | 8/2003 | Takahashi et al. | 361/115 |

FOREIGN PATENT DOCUMENTS

| | | | |
|---|---|---|---|
| DE | 868 012 | | 11/1939 |
| DE | 198 32 089 A1 | | 1/2000 |
| FR | 2 698 459 A1 | | 5/1994 |
| JP | 410050178 | * | 7/1996 |

* cited by examiner

*Primary Examiner*—Michael Friedhofer
*Assistant Examiner*—Lisa Klau
(74) *Attorney, Agent, or Firm*—Laurence A. Greenberg; Werner H. Stemer; Ralph E. Locher

(57) ABSTRACT

A rotary switch configuration for a household appliance includes a rotary knob seated in a cutout in an appliance panel and firmly connected to an actuating shaft so as to rotate with it but move axially, the actuating shaft transmitting the rotary movement of the rotary knob to a switching shaft of a switching unit mounted behind the appliance panel. Exact and wobble-free guidance of the rotary knob is achieved by the actuating shaft being rotatably mounted on the appliance panel by a bearing device.

20 Claims, 1 Drawing Sheet

ROTARY SWITCH CONFIGURATION FOR A HOUSEHOLD APPLIANCE

CROSS-REFERENCE TO RELATED APPLICATION

This application is a continuation of copending International Application No. PCT/EP01/10292, filed Sep. 6, 2001, which designated the United States and was not published in English.

BACKGROUND OF THE INVENTION

FIELD OF THE INVENTION

The invention relates to a rotary switch configuration for a household appliance, which configuration has a rotary knob that is seated in a cutout in an appliance panel and is firmly connected to an actuating shaft so as to rotate with it but move axially, the shaft transmitting the rotary movement of the rotary knob to the switching shaft of a switching unit mounted behind the appliance panel.

A configuration is disclosed by German Published, Non-Prosecuted Patent Application DE 198 32 089 A, in which the actuating shaft firmly connected to the rotary knob so as to rotate with it can be plugged onto the switching shaft of the switching unit and is carried by the latter. The rotary knob, itself, is coupled to the actuating shaft through a cardan joint. By the cardan joint, an axial offset occurring because of fabrication tolerances between an opening in the appliance panel that accommodates the rotary knob and the switching shaft of the switching unit is compensated for. However, the mobility provided by the cardan joint leads to the rotary knob being able to move radially, corresponding to the play existing between its outer circumference and the inner circumference of the opening. It is, therefore, possible for the rotary knob to rub on the inner circumference of the opening.

SUMMARY OF THE INVENTION

It is accordingly an object of the invention to provide a rotary switch configuration for a household appliance that overcomes the hereinafore-mentioned disadvantages of the heretofore-known devices of this general type and that provides exactly central and wobble-free guidance of the rotary knob in the opening.

With the foregoing and other objects in view, there is provided, in accordance with the invention, a rotary switch configuration for a household appliance with an appliance panel defining a cutout and having first and second opposing sides, including an actuating shaft having an axial direction, a rotary knob to be seated in the cutout at the first side of the appliance panel, the rotary knob being firmly rotatably connected to the actuating shaft for rotation with the actuating shaft and being movably connected to the actuating shaft in the axial direction for axial movement with respect to the actuating shaft, a switching unit being mounted opposite the rotary knob at the second side of the appliance panel, the switching unit having a switching shaft, the actuating shaft being connected to the switching shaft to transmit rotary movement of the rotary knob to the switching shaft, and a bearing device adapted to rotatably mount the actuating shaft to the appliance panel.

According to the invention, the actuating shaft is rotatably mounted on the appliance panel by a bearing device. As a result of mounting the actuating shaft on the appliance panel, exact central alignment of the rotary knob with respect to the opening, likewise provided on the appliance panel and accommodating the rotary knob, is possible. A wobble-free configuration of the actuating shaft is achieved by the bearing device.

With the objects of the invention in view, in a household appliance having an appliance panel defining a cutout, the panel having first and second opposing sides, there is also provided a rotary switch configuration including an actuating shaft having an axial direction, a rotary knob being seated in the cutout at the first side of the appliance panel, the rotary knob being firmly rotatably connected to the actuating shaft for rotation with the actuating shaft and being movably connected to the actuating shaft in the axial direction for axial movement with respect to the actuating shaft, a switching unit being mounted opposite the rotary knob at the second side of the appliance panel, the switching unit having a switching shaft, the actuating shaft being connected to the switching shaft to transmit rotary movement of the rotary knob to the switching shaft, and a bearing device rotatably mounting the actuating shaft to the appliance panel.

It is particularly advantageous to mount the actuating shaft rotatably by a ball bearing because a ball bearing has particularly little play and maintains this property even over a long period of use.

Assembly advantages result from the fact that the ball bearing is disposed in a bearing support that can be fixed to the appliance panel. Such a bearing support can be configured as a bearing ring that can be inserted into a bearing opening in the appliance panel. Such a bearing ring can be inserted in a simple way into a bearing opening provided on the appliance panel. In such a case, the bearing ring can be mounted in the bearing opening by latching elements provided on the bearing ring. Therefore, only one operation is required to fit and fix the bearing ring in the bearing opening.

Furthermore, it is advantageous for there to be provided on the bearing ring a collar that runs in a cone shape and projects towards the rotary knob. Such a collar constitutes a centering aid during the mounting of the actuating shaft.

Fabrication generally leads to an offset between the center of the switching shaft of the switching unit and the center of the actuation shaft. It is, therefore, expedient to couple the actuating shaft to the switching shaft by a coupling device that compensates for an axial offset. This may be achieved, in a constructionally simply way by configuring the coupling device as a plug-in cardan coupling.

In accordance with a concomitant feature of the invention, the coupling device has a slot and a pin.

Other features that are considered as characteristic for the invention are set forth in the appended claims.

Although the invention is illustrated and described herein as embodied in a rotary switch configuration for a household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
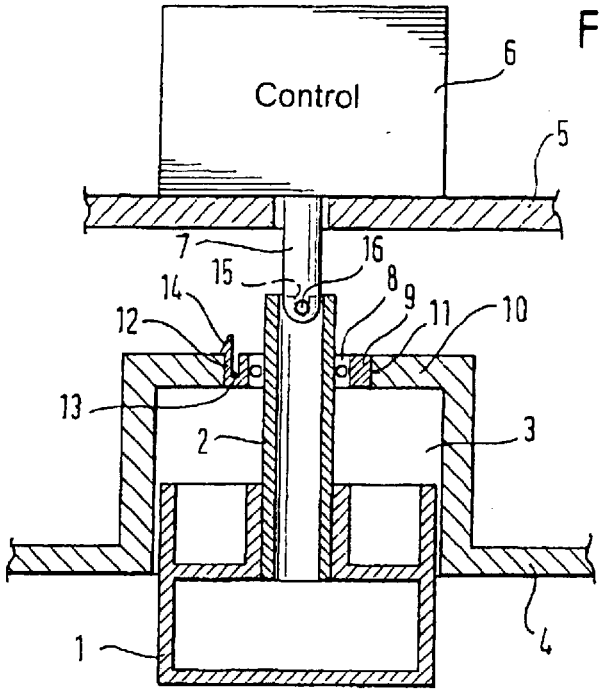
FIG. 1 is a fragmentary, cross-sectional view of a rotary switch configuration according to the invention.
Figure 2:
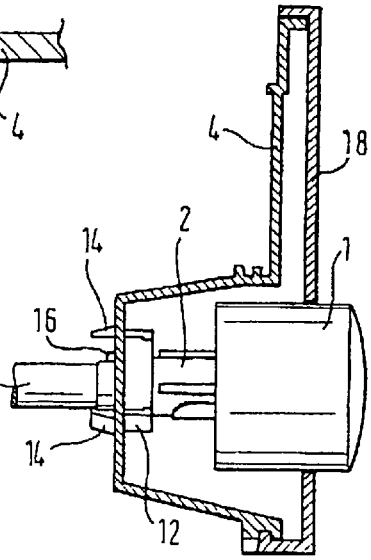
FIG. 2 is a fragmentary, partial plan and cross-sectional view of the switch configuration of FIG. 1.

Referring now to the figures of the drawings in detail and first, particularly to FIGS. 1 and 2 thereof, there is shown a rotary knob 1 that, in a conventional way, is disposed firmly on an actuating shaft 2 so as to rotate with it but such that it can be displaced axially. During axial displacement, the rotary knob 1 either penetrates into an accommodating niche 3 in an appliance panel 4 or emerges from the accommodating niche 3 so that it can be gripped and adjusted by hand. Disposed behind the appliance panel 4, on a supporting plate 5, is a switching or control unit 6, which has a switching shaft 7 that can be coupled to the actuating shaft 2. A cover 18 can be provided at the knob 1 above the appliance panel 4.

The actuating shaft 2 is rotatably mounted in a bearing ring 9 by a ball bearing 8. The bearing ring 9 is inserted into a bearing opening 11 provided on the bottom wall 10 of the accommodating niche 3. A plurality of latching tabs 12, preferably, three, is integrally molded on the outer circumference of the bearing ring 9, distributed uniformly over the circumference. The latching tabs 12 engage through radial cuts 13 formed on the inner circumference of the bearing opening 11 and hook with their latching tongues 14 on the outer side of the bottom wall 10. The bearing ring 9 and, thus, also the actuating shaft 2 are, therefore, firmly anchored to the bottom wall 10.

As a result of the formation of the bearing opening 11 on the bottom wall 10 of the accommodating niche 3, exact centering of the bearing opening 11 with respect to the accommodating niche 3 is possible. As a result, exact centering of the rotary knob 1 disposed on the actuating shaft 2 with respect to the accommodating niche 3 is also provided. By using a ball bearing 8 to mount the actuating shaft 2, a very accurate and virtually play-free mounting is achieved so that the rotary knob 1 is also guided correspondingly exactly, that is to say, in a wobble-free manner, in the accommodating niche 3.

The switching shaft 7 is, expediently, coupled to the actuating shaft 2 of the rotary knob 1 by a plug-in cardan coupling. For such a purpose, at the free end of the actuating shaft 2 pointing toward the switching or control unit 6 there are formed two mutually opposite slots 15, in which a pin 16 pushed through an appropriate hole in the switching shaft 7 engages. The actuating shaft 2 is also hollow at its free end so that the switching shaft 7 can be plugged into the actuating shaft 2 to such an extent that the pin 16 engages in the slots 15. By such a coupling, any central offset possibly existing between the switching shaft 7 and the actuating shaft 2 can be compensated for.

Figure 3:
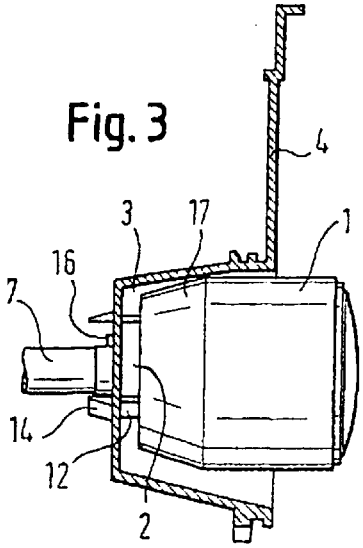
FIG. 3 is a fragmentary, partial plan and cross-sectional view of an alternative embodiment of the rotary knob of the rotary switch configuration of FIG. 1.
Figure 4:
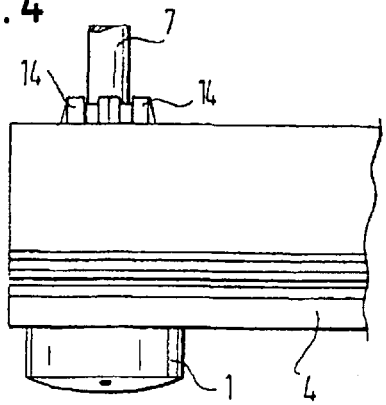
FIG. 4 is a fragmentary, plan view of the rotary switch configuration of FIG. 3.

As FIGS. 3 and 4 show, a collar 17 that widens in a cone shape towards the rotary knob 1 is provided on the bearing ring 9. The collar 17 can be supported on the inner circumference of the accommodating niche 3 and, thus, serves to center the actuating shaft 2 and, therefore, also the rotary knob 1 in the accommodating niche 3. In addition, the external diameter of the collar 17 can be dimensioned to be slightly larger than the external diameter of the rotary knob 1 so that the rotary knob 1 can, reliably, be prevented from rubbing on the inner wall of the accommodating niche 3. As such, visually disturbing traces of rubbing on the outside of the rotary knob 1 are avoided.

We claim:

1. A rotary switch configuration for a household appliance with an appliance panel defining a cutout and having first and second opposing sides, comprising:

an actuating shaft having an axial direction;

a rotary knob to be seated in the cutout at the first side of the appliance panel, said rotary knob being firmly rotatably connected to said actuating shaft for rotation with said actuating shaft and being movably connected to said actuating shaft in said axial direction for axial movement with respect to said actuating shaft;

a switching unit being mounted opposite said rotary knob at the second side of the appliance panel, said switching unit having a switching shaft;

said actuating shaft being connected to said switching shaft to transmit rotary movement of said rotary knob to said switching shaft; and a bearing device adapted to rotatably mount said actuating shaft to the appliance panel.

2. The configuration according to claim 1, further comprising a ball bearing rotatably mounting said actuating shaft.

3. The configuration according to claim 2, further comprising a bearing support to be fixed to the appliance panel, said ball bearing being disposed in said bearing support.

4. The configuration according to claim 3, wherein:

the appliance panel defines a bearing opening; and said bearing support is a bearing ring to be inserted into the bearing opening.

5. The configuration according to claim 4, wherein said bearing ring has latching elements adapted to hold said bearing ring in the bearing opening.

6. The configuration according to claim 4, wherein said bearing ring has a collar extending in a cone shape and projecting toward said rotary knob.

7. The configuration according to claim 1, wherein said bearing device has a ball bearing rotatably mounting said actuating shaft.

8. The configuration according to claim 1, further comprising a coupling device coupling said actuating shaft to said switching shaft, said coupling device compensating for axial offset.

9. The configuration according to claim 8, wherein said coupling device is a plug-in cardan coupling.

10. The configuration according to claim 8, wherein said coupling device has a slot and a pin.

11. In a household appliance having an appliance panel defining a cutout, the panel having first and second opposing sides, a rotary switch configuration comprising:

an actuating shaft having an axial direction;

a rotary knob being seated in the cutout at the first side of the appliance panel, said rotary knob being firmly rotatably connected to said actuating shaft for rotation with said actuating shaft and being movably connected to said actuating shaft in said axial direction for axial movement with respect to said actuating shaft;

a switching unit being mounted opposite said rotary knob at the second side of the appliance panel, said switching unit having a switching shaft;

said actuating shaft being connected to said switching shaft to transmit rotary movement of said rotary knob to said switching shaft; and a bearing device rotatably mounting said actuating shaft to the appliance panel.

12. The configuration according to claim 11, further comprising a ball bearing rotatably mounting said actuating shaft.

13. The configuration according to claim 12, further comprising a bearing support fixed to the appliance panel, said ball bearing being disposed in said bearing support.

14. The configuration according to claim 13, wherein:

the appliance panel defines a bearing opening; and said bearing support is a bearing ring inserted into the bearing opening.

15. The configuration according to claim 14, wherein said bearing ring has latching elements holding said bearing ring in the bearing opening.

16. The configuration according to claim 14, wherein said bearing ring has a collar extending in a cone shape and projecting toward said rotary knob.

17. The configuration according to claim 11, wherein said bearing device has a ball bearing rotatably mounting said actuating shaft.

18. The configuration according to claim 11, further comprising a coupling device coupling said actuating shaft to said switching shaft, said coupling device compensating for axial offset.

19. The configuration according to claim 18, wherein said coupling device is a plug-in cardan coupling.

20. The configuration according to claim 18, wherein said coupling device has a slot and a pin.

* * * * *